US009484617B2

(12) United States Patent
Takahashi

(10) Patent No.: US 9,484,617 B2
(45) Date of Patent: Nov. 1, 2016

(54) ANTENNA DEVICE AND METHOD FOR ATTACHING THE SAME

(71) Applicant: NEC Corporation, Tokyo (JP)

(72) Inventor: Yoshihide Takahashi, Tokyo (JP)

(73) Assignee: NEC Corporation, Tokyo (JP)

( * ) Notice: Subject to any disclaimer, the term of this patent is extended or adjusted under 35 U.S.C. 154(b) by 44 days.

(21) Appl. No.: 14/398,523

(22) PCT Filed: Jan. 9, 2013

(86) PCT No.: PCT/JP2013/000029
§ 371 (c)(1),
(2) Date: Nov. 3, 2014

(87) PCT Pub. No.: WO2013/168319
PCT Pub. Date: Nov. 14, 2013

(65) Prior Publication Data

US 2015/0138022 A1 May 21, 2015

(30) Foreign Application Priority Data

May 8, 2012 (JP) ..... 2012-106616

(51) Int. Cl.
*H01Q 19/12* (2006.01)
*H01Q 1/12* (2006.01)
(Continued)

(52) U.S. Cl.
CPC ..... *H01Q 1/1242* (2013.01); *H01Q 1/1228* (2013.01); *H01Q 1/22* (2013.01); *H01Q 1/526* (2013.01); *H01Q 19/13* (2013.01); *H01Q 19/132* (2013.01); *Y10T 29/49018* (2015.01)

(58) Field of Classification Search
CPC .. H01Q 19/13; H01Q 1/1228; H01Q 1/1242; H01Q 19/132; H01Q 1/52
USPC ..... 343/781 R, 840, 872, 878
See application file for complete search history.

(56) References Cited

U.S. PATENT DOCUMENTS 3,075,191 A * 1/1963 Peay ..... H01Q 1/428 343/766
3,351,947 A * 11/1967 Hart ..... H01Q 1/42 343/840

(Continued)

FOREIGN PATENT DOCUMENTS

CN 2879452 Y 3/2007
CN 101615723 A 12/2009

(Continued)

OTHER PUBLICATIONS

Chinese Notification of First Office Action corresponding to Chinese Application No. 201380024469.2, dated Sep. 17, 2015, 19 pages.

(Continued)

*Primary Examiner* — Tho G Phan
(74) *Attorney, Agent, or Firm* — Wilmer Cutler Pickering Hale and Dorr LLP

(57) ABSTRACT

An antenna device includes: a radio device for radio wave transmission; a primary radiator that has a function to radiates radio waves generated by the radio device; a parabolic reflector that reflects the radio waves radiated from the primary radiator; a shroud that shields against unnecessary radiation radio waves among the radio waves radiated from the primary radiator and reflected by the parabolic reflector; and an antenna mounting mechanism that fits the parabolic reflector to an antenna attachment pole. The shroud is arranged so as to cover at least a right and left of the parabolic reflector, the radio device and the primary radiator are arranged inside the shroud, and the antenna mounting mechanism fits the parabolic reflector to the antenna attachment pole so that the antenna attachment pole is located at a lateral center position of the parabolic reflector.

10 Claims, 9 Drawing Sheets

(51) Int. Cl.

| | |
|---|---|
| ***H01Q 1/22*** | (2006.01) |
| ***H01Q 1/52*** | (2006.01) |
| ***H01Q 19/13*** | (2006.01) |

(56) References Cited

U.S. PATENT DOCUMENTS

| | | | | |
|---|---|---|---|---|
| 3,388,401 | A * | 6/1968 | Weir | H01Q 1/427 343/872 |
| 4,012,743 | A | 3/1977 | Maciejewski | |
| 4,016,570 | A | 4/1977 | Arkind et al. | |
| 4,312,002 | A * | 1/1982 | Stewart | H01Q 1/42 343/725 |
| 4,316,195 | A * | 2/1982 | Steffek | H01Q 5/45 343/754 |
| 4,581,615 | A * | 4/1986 | Levy | H01Q 19/19 343/755 |
| 5,019,833 | A * | 5/1991 | Nonaka | H01Q 1/125 343/720 |
| 7,868,845 | B2 | 1/2011 | Gratton et al. | |

FOREIGN PATENT DOCUMENTS

| | | | |
|---|---|---|---|
| CN | 201758184 | U | 3/2011 |
| CN | 201812922 | U | 4/2011 |
| CN | 102232258 | A | 11/2011 |
| FR | 2300428 | A1 | 9/1976 |
| JP | 01-233804 | A | 9/1989 |
| JP | 04-113706 | | 4/1992 |
| JP | 08-195610 | A | 7/1996 |
| JP | 10-322111 | | 12/1998 |
| JP | 2002-111360 | A | 4/2002 |
| JP | 2006-081041 | A | 3/2006 |
| JP | 2011-082648 | A | 4/2011 |
| JP | 2012199765 | A | 10/2012 |
| RU | 2334316 | C1 | 9/2008 |
| UA | 23552 | U | 5/2007 |

OTHER PUBLICATIONS

Extended European Search Report issued in corresponding European Application No. 13787790.8, dated Dec. 1, 2015, 9 pages.

Timofeyeva A. A., et al. "A Broadband Nonaxisymmetrical Antenna with an Aperture Diameter of 1.5m", Telecommunications and Radio Engineeringm Scripta Technica, Inc., New York, NY, US, vol. 41/42, No. 3, Mar. 1, 1987, pp. 19-23 (6 pages), XP001383819.

International Search Report corresponding to PCT/JP2013/000029, dated Mar. 19, 2013 (3 pages).

Russian Office Action issued by the Russian Federal Service on Intellectual Property for Application No. 2014145009/28(072547) dated Jan. 14, 2016 (15 pages).

* cited by examiner

ANTENNA DEVICE AND METHOD FOR ATTACHING THE SAME

CROSS-REFERENCE TO RELATED APPLICATIONS

This application is a national stage application of International Application No. PCT/JP2013/000029 entitled "Antenna Device and Method for Attaching the Same" filed on Jan. 9, 2013, which claims the benefit of the priority of Japanese Patent Application No. 2012-106616, filed on May 8, 2012, the disclosures of each of which are hereby incorporated by reference in their entirety.

TECHNICAL FIELD

The present invention relates to an antenna device and a method for manufacturing the same, and particularly, to an offset parabolic antenna for a point-to-point communication line and a method for attaching the same.

BACKGROUND ART

As an antenna for a point-to-point communication line, a parabolic antenna has been widely used. Particularly when a severe low side lobe characteristic is required, an offset parabolic antenna may be used.

In Patent Literature 1, an offset parabolic antenna is disclosed in which a worker can easily perform adjustment work of a polarization plane angle. The Patent Literature 1 discloses a method for offsetting a position of an antenna attachment pole with respect to a reflector lateral center, and mounting the offset parabolic antenna.

While realization of the low side lobe characteristic is an important object in the parabolic antenna, it also becomes an important object to have a strength maintaining structure in consideration of the wind pressure load resistance in design of the parabolic antenna. Particularly, when a technique for realizing the low side lobe characteristic is adopted in which an unnecessary radiation shielding plate called a shroud is provided, a wind pressure load tends to increase since a wind receiving area becomes large with respect to a crosswind.

It is necessary in the parabolic antenna to strengthen an antenna mounting mechanism for mounting the parabolic antenna to the antenna attachment pole in order to improve a strength characteristic of the wind pressure load resistance, which increases a degree of difficulty in antenna manufacturing, and becomes a factor for increasing a cost of manufacturing an antenna device.

As a method for attaching a parabolic antenna having a comparatively high strength wind pressure load resistance, there is included an attachment method disclosed in Patent Literature 2. In the attachment method, the parabolic antenna has a structure for covering an antenna attachment pole with a reflector mounting part from an upper part thereof, and thereby the strength of the wind pressure load resistance is improved.

CITATION LIST

Patent Literature

Patent Literature 1: Japanese Unexamined Patent Application Publication No. 2002-111360

Patent Literature 2: Japanese Unexamined Patent Application Publication No. 2011-82648

SUMMARY OF INVENTION

Technical Problem

A first problem for an offset parabolic antenna for a point-to-point communication line is related to giving an antenna device a structure capable of withstanding a wind pressure load. More particularly, providing the antenna device with such a structure leads to a problem of an increase in rotation torque applied to a contact surface of an antenna mounting mechanism and an antenna attachment pole.

For the point-to-point communication line, there has been a demand that a plurality of antennas be installed with respect to one antenna attachment pole in order to address the problem of tight communication capacity. However, in an attachment structure to cover the antenna attachment pole with a reflector mounting part from the upper part thereof, which attachment structure is disclosed in Patent Literature 2, the number of antennas that can be installed is limited. Consequently, it is preferable to have a structure in which metal fittings for an antenna mounting are used to sandwich the pole between the metal fittings as disclosed in Patent Literature 1 to increase communication capacity. Meanwhile, in the attachment method of Patent Literature 1, the antenna mounting mechanism must be made strong so that the antenna does not rotate with respect to the pole due to a wind pressure load applied to the antenna. This increases the degree of difficulty in manufacturing of the antenna mounting mechanism, and eventually becomes a factor in making the manufacturing cost high.

A second problem is the problem of power loss of a primary radiator of the offset parabolic antenna. In the offset parabolic antenna, a position of the primary radiator is offset from a reflector center position, and thus when a structure is employed in which a radio device is arranged at a back surface of a reflector and is directly coupled to the primary radiator, a length of a waveguide used for the primary radiator becomes long, and a bent part and a twist are generated in a waveguide. This structure becomes a factor in increasing the power loss and occurrence of cross polarization. In addition, since a structure of the primary radiator is complicated, a manufacturing cost becomes high.

In view of the above-described problems, an object of the present invention is to provide an antenna device for which a cost is low and a strength characteristic of wind pressure load resistance and a power loss characteristic are improved, and a method for attaching the antenna device.

Solution to Problem

An antenna apparatus according to the present invention includes: a radio device for radio wave transmission or for radio wave reception; a primary radiator that has a function to radiate radio waves generated by the radio device or a function to feed received radio waves to the radio device; a parabolic reflector that reflects the radio waves radiated from the primary radiator or makes the primary radiator receive radio waves by reflecting the radio waves; a shroud that shields against unnecessary radiation radio waves among the radio waves radiated from the primary radiator and reflected by the parabolic reflector, or shields against radio waves requiring no reception so that the radio waves requiring no reception are not reflected by the parabolic reflector and are not received by the primary radiator; and an antenna mounting mechanism that fits the parabolic reflector to an antenna attachment pole. The shroud is arranged so as to cover at least a right and left of the parabolic reflector, the radio device and the primary radiator are arranged inside the shroud, and the antenna mounting mechanism fits the parabolic reflector to the antenna attachment pole so that the antenna attachment pole is located at a lateral center position of the parabolic reflector.

A method for attaching an antenna device according to the present invention includes following steps (a) and (b);

(a) providing a shroud so as to cover at least a right and left of a parabolic reflector that reflects radio waves, providing a radio device for radio wave transmission or for radio wave reception inside the shroud, and providing a primary radiator that has a function to radiate radio waves generated by the radio device or a function to feed received radio waves to the radio device inside the shroud so that the parabolic reflector reflects the radio waves radiated from the primary radiator or reflects the radio waves so that the primary radiator receives the radio waves, and (b) providing an antenna mounting mechanism that fits the parabolic reflector to an antenna attachment pole in order for the parabolic reflector to be fitted to the antenna attachment pole so that the antenna attachment pole is located at a lateral center position of the parabolic reflector.

Advantageous Effects of Invention

With the present invention, it is possible to provide an antenna device for which a cost is low and a strength characteristic of wind pressure load resistance and a power loss characteristic are improved, and a method for attaching the antenna device.

DESCRIPTION OF EMBODIMENTS

Embodiments of the present invention will be explained hereinafter with reference to drawings. The following description shows preferred embodiments of the present invention, and the scope of the present invention is not limited to the following embodiments. In the following description, components to which the same symbol is attached indicate a substantially similar content.

Embodiment 1

Figure 1:
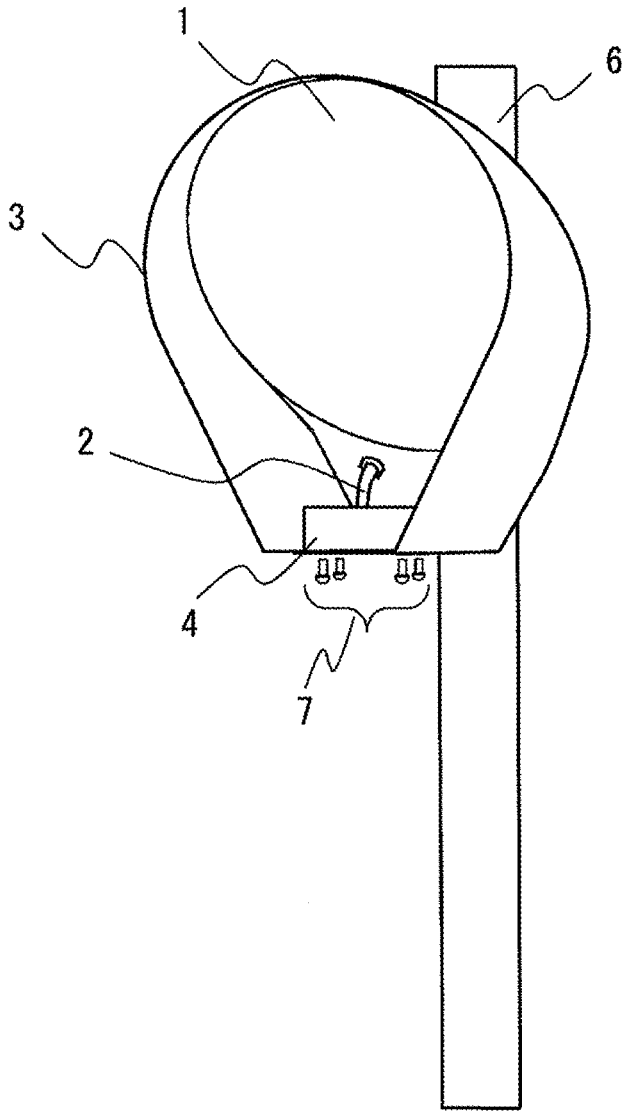
FIG. 1 is a perspective diagram of an antenna device according to an embodiment 1.
Figure 2:
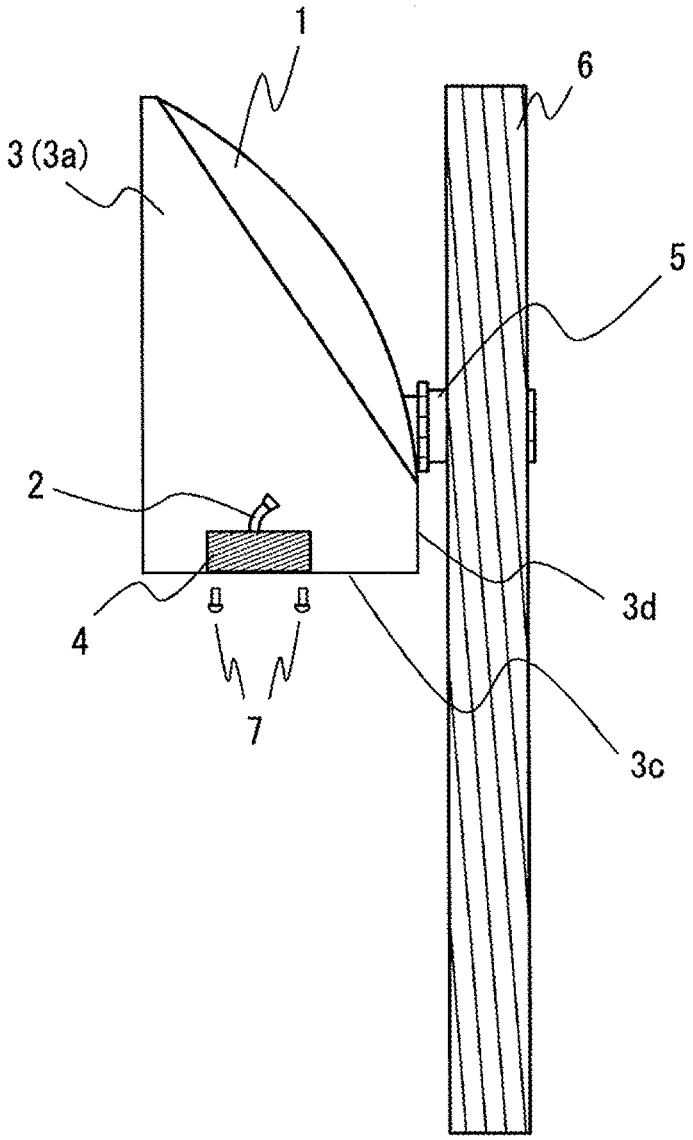
FIG. 2 is a side cross-sectional diagram of the antenna device according to the embodiment 1.
Figure 3:
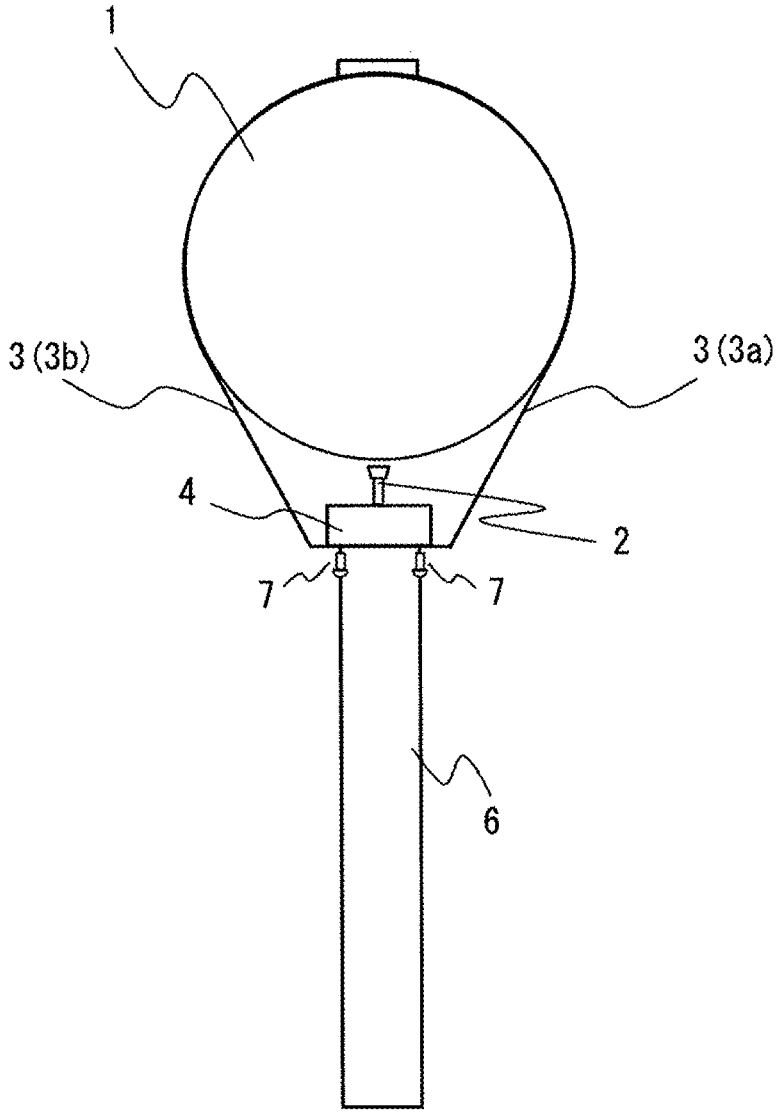
FIG. 3 is an elevational diagram of the antenna device according to the embodiment 1.

Hereinafter, the embodiments of the present invention will be explained with reference to drawings. FIGS. 1 to 3 show a perspective diagram, a side cross-sectional diagram, and an elevational diagram of an antenna device 10 according to the embodiment 1, respectively.

The antenna device 10 is specifically an offset parabolic antenna for a point-to-point communication line, and is provided with: an offset reflector 1; a primary radiator 2; a shroud 3; a radio device 4; and an antenna mounting mechanism 5.

The offset reflector 1 is a circular reflector, and reflects radio waves radiated by the primary radiator 2 in a front direction. An attachment angle of the offset reflector 1 is adjusted so as to reflect the radio waves radiated from the primary radiator 2 in a horizontal direction.

The primary radiator 2 is a horn antenna formed so that a cross-sectional area of an opening end becomes gradually wider. The primary radiator 2 is arranged outside an antenna opening, i.e., at a position under a lower end of the offset reflector 1 so as not to prevent radiation of the radio waves. Here, although the primary radiator 2 is explained as being a truncated conical horn antenna in which a cross section of a waveguide portion is circular, a horn antenna using a truncated pyramid-shaped waveguide whose cross section is rectangular may be employed. The primary radiator 2 is directly coupled to an external interface of the radio device 4 arranged inside the shroud 3.

The shroud 3 is an unnecessary radiation shielding plate arranged to realize a low side lobe characteristic. The shroud 3 is arranged so as to cover the offset reflector 1. The shroud 3 is symmetrically formed.

As shown in FIGS. 1 to 3, the shroud 3 has at least side portions (a shroud right side surface part 3*a*, a shroud left side surface part 3*b*) that cover a right and left of the offset reflector 1, respectively, and a bottom surface portion (a shroud bottom surface part 3*c*) that connects lower ends of both of the side surface portions. In addition, the shroud 3 is located at a lower part of the offset reflector 1, and has a back surface portion (a shroud back surface part 3*d*) that connects lower back surface sides of the shroud right side surface part 3*a* and the shroud left side surface part 3*b*.

The shroud bottom surface part 3*c*, which is a lower part of the shroud 3, is formed as a flat surface in order to attach the radio device 4 thereto.

In addition, upper sides of the shroud right side surface part 3*a* and the shroud left side surface part 3*b*, which are the side surfaces of the shroud 3, are connected to each other near a vertex of an upper part of the offset reflector 1, and they are formed by curved surfaces having bulges so as to cover a right and left of the offset reflector 1. It is to be noted that "covering a right and left" means here a shape in which the shroud right side surface part 3*a* and the shroud left side surface part 3*b* project from the right and left side surfaces of the offset reflector 1, respectively, to a front of the offset reflector 1 (in a direction of a mirror surface of the offset reflector 1).

In addition, lower parts of the shroud right side surface part 3*a* and the shroud left side surface part 3*b* are formed so as to taper to opposite sides, respectively. Namely, a distance between the shroud right side surface part 3*a* and the shroud left side surface part 3*b* is 0 at upper portions thereof since they are connected to each other, and they bulge near middle portions thereof until the distance becomes approximately the same as a diameter of the offset reflector 1, and subsequently, they taper at lower portions thereof so that the distance becomes not more than the diameter of the offset reflector 1. Here, as a distance between the lower parts of the shroud right side surface part 3*a* and the shroud left side surface part 3*b*, a length not less than a width of the radio device 4 is maintained so that the radio device 4 can be arranged.

The shroud right side surface part 3*a*, the shroud left side surface part 3*b*, the shroud bottom surface part 3*c*, and the shroud back surface part 3*d* that configure the shroud 3 may be individually designed. The shroud 3 is formed by combining the shroud right side surface part 3*a*, the shroud left side surface part 3*b*, the shroud bottom surface part 3*c*, and the shroud back surface part 3*d* with each other.

According to the above-described configuration of the shroud 3, the shroud 3 can shield against radio waves (unnecessary radiation radio waves) radiated in directions other than a direction (the front direction here) targeted by the offset reflector 1 from an outside of the antenna device 10.

In addition, the shroud 3 may be formed by integrally molding the shroud right side surface part 3*a*, the shroud left side surface part 3*b*, the shroud bottom surface part 3*c*, and the shroud back surface part 3*d*.

The radio device 4 is connected to a cable, which is not shown, and includes an RF (Radio Frequency) circuit that generates transmission radio waves, and a modulation circuit that modulates the generated radio waves, etc. and outputs the modulated radio waves to the primary radiator 2 through an interface.

The radio device 4 directly coupled to the primary radiator 2 is arranged inside the shroud 3. Here, the inside of the shroud 3 means an inside of a space surrounded by the shroud 3. Since a front of the shroud 3 is in an opened state to radiate radio waves, a region sandwiched by the shroud right side surface part 3*a* and the shroud left side surface part 3*b*, which are the side surfaces of the shroud 3, serves as the inside of the shroud 3. Accordingly, the radio device 4 is installed on an inner surface of the shroud 3 having outer and inner surfaces, and thereby the radio device 4 is arranged inside the shroud 3.

As shown in FIGS. 1 to 3, in the embodiment 1, the radio device 4 is attached to the shroud 3, i.e., to an inner surface of the shroud bottom surface part 3*c*, which is a lower inside of the shroud 3, by attachment screws 7. In the embodiment 1, four of the attachment screws 7 are inserted from a lower outside of the shroud 3 so as to fix four corners of the radio device 4, and thereby the radio device 4 is fixed to the lower inside of the shroud 3.

It is to be noted that a method for attaching the radio device 4 to the shroud 3 is not limited to a method for attaching it by the attachment screws 7 and that, for example, a method for fixing it using a rivet and an adhesive may be employed.

The antenna mounting mechanism 5 is an attachment mechanism for attaching the antenna device 10 to an antenna attachment pole 6. As shown in FIGS. 2 and 3, the antenna device 10 is attached to the antenna attachment pole 6 by the antenna mounting mechanism 5 so that an arrangement position of the antenna attachment pole 6 is located at a lateral center position of the offset reflector 1.

Namely, the antenna mounting mechanism 5 is arranged at the lateral center position of the antenna device 10. In the embodiment 1, the antenna mounting mechanism 5 is arranged at a lateral center position of a lower back surface of the offset reflector 1.

However, an arrangement position of the antenna mounting mechanism 5 is not limited to the back surface of the offset reflector 1. A position of the center of gravity of the antenna device 10 leans downwardly as a whole since the radio device 4 is attached to the lower inside of the shroud 3. Consequently, in order to reduce torque generated in the antenna mounting mechanism 5, a configuration may be employed in which the antenna mounting mechanism 5 is arranged so as to be installed at the back surface of the shroud 3 located at a lower part of the offset reflector 1.

The above-described offset reflector 1, primary radiator 2, and shroud 3 are made of materials having conductivity, and a material covered with metal by metal plating and a material covered with a metal sheet can be used.

In addition, the primary radiator 2 is not limited to the horn antenna, and instead may be an antenna that radiates broad beams, such as a dipole antenna.

In addition, an electromagnetic wave absorber may be further installed inside the shroud 3. The electromagnetic wave absorber installed inside the shroud 3 absorbs unnecessary electromagnetic waves, thereby an unnecessary radiation shielding function of the shroud 3 can be improved, and the low side lobe characteristic can be enhanced.

Next, an operation principle in the embodiment 1 will be explained. In the configuration, the antenna device 10 operates as an antenna by reflecting radio waves radiated by the primary radiator 2, which is the horn antenna, in the front direction by the offset reflector 1. In order to achieve the low side lobe characteristic, opening surface electric field distribution of the offset reflector 1 is adjusted so that electric field strength of an opening surface edge part of the reflector is smaller than a center part of the reflector by several dB (for example, 12 dB). The shroud 3 operates so that no spillover occurs due to the primary radiator 2, and so that scatter components caused by a reflector edge part is prevented from being externally radiated.

The shroud 3 has a strength structure for supporting the radio device 4. The antenna mounting mechanism 5 has a structure capable of withstanding a wind pressure load applied to the antenna. When the wind pressure load is applied to the antenna, the antenna mounting mechanism 5 operates so that rotation torque applied to a contact surface of the antenna mounting mechanism 5 and the antenna attachment pole 6 becomes small.

As described above, the antenna device according to the embodiment 1 of the present invention is an antenna device including: an offset parabolic reflector; a primary radiator; a shroud; a radio device; and an antenna mounting mechanism. Here, the antenna device is characterized in that the radio device and the primary radiator are fitted inside the shroud, and that the antenna mounting mechanism and the antenna attachment pole are fitted to a lateral center position of the offset parabolic reflector.

More specifically, the antenna device according to the embodiment 1 includes: the radio device that generates transmission radio waves; the primary radiator that radiates the radio waves generated by the radio device; the parabolic reflector that reflects the radio waves radiated from the primary radiator; the shroud that shields against unnecessary radiation radio waves among the radio waves reflected by the parabolic reflector; and the antenna mounting mechanism that fits the parabolic reflector to the antenna attachment pole. Here, the antenna device is characterized in that the shroud is arranged so as to cover at least a right and left of the parabolic reflector, and that the radio device and the primary radiator are arranged inside the shroud. Furthermore, the antenna device is characterized in that the antenna mounting mechanism fits the parabolic reflector to the antenna attachment pole so that the antenna attachment pole is located at a lateral center position of the parabolic reflector.

The antenna mounting mechanism arranged at the lateral center of the parabolic reflector can reduce rotation torque applied to a contact surface of the mount and the antenna attachment pole due to a wind pressure load applied to the antenna, as compared with a case where the mount is installed so as to be offset from the lateral center of the reflector. For this reason, the antenna mounting mechanism can be made to have a simpler structure, and a cost reduction can be achieved. In addition, a structure is employed in which the radio device is fitted inside the shroud so that the primary radiator is directly coupled to the radio device, thereby a length of a waveguide used for the primary radiator can be shortened, a power loss characteristic can be improved, and cost reduction can be achieved. It is to be noted that the lateral center is not necessarily an exact lateral center, and the lateral center may include a case of having deviation from the exact lateral center, if the above-mentioned rotation torque is smaller as compared with the case of being offset from the lateral center.

It is to be noted that although the antenna device 10 used for radio wave transmission has been explained in the above, a configuration similar to that of the antenna device 10 can be used for radio wave reception. In that case, the offset reflector 1 reflects radio waves radiated from an outside of the antenna device 10 (particularly, radio waves radiated from the front direction of the offset reflector 1), and makes the primary radiator 2 receive the reflected radio waves. The primary radiator 2 feeds the received radio waves to the radio device 4 through an interface. The radio device 4 is a radio device for radio wave reception, and includes a tuning circuit that takes out a target radio wave signal, a demodulation circuit that demodulates the radio waves, etc. The shroud 3 shields against radio waves requiring no reception so that the radio waves that are not require to be received (radio waves requiring no reception) among the radio waves radiated from the outside of the antenna device 10 are not reflected by the offset reflector 1 and are not received by the primary radiator 2. These radio waves requiring no reception are specifically radio waves radiated from a direction other than the front of the offset reflector 1. When a transmission antenna device (the configuration thereof is, for example, as above), which is a reception target of the antenna device 10, is present in the front of the offset reflector 1, the shroud 3 of the antenna device 10 shields against the radio waves radiated from devices other than the transmission antenna device. The rest of detailed configuration and arrangement of each part of the antenna device 10 are as above.

Although in FIGS. 1 to 3, the radio device 4 and the primary radiator 2 are directly coupled to each other, and the radio device 4 is arranged at the lower inside of the shroud, arrangement of the radio device 4 and the primary radiator 2 may not be just like this. In addition, the offset reflector 1 may not be circular.

Embodiment 2

An antenna device according to the embodiment 2 is characterized in that a support (a support member) that supports a radio device is further installed inside the shroud 3. Hereinafter, the embodiment 2 will be explained in detail with reference to the drawings. However, explanation of a portion already explained in the embodiment 1 is partially omitted for clarity of the invention.

Figure 4:
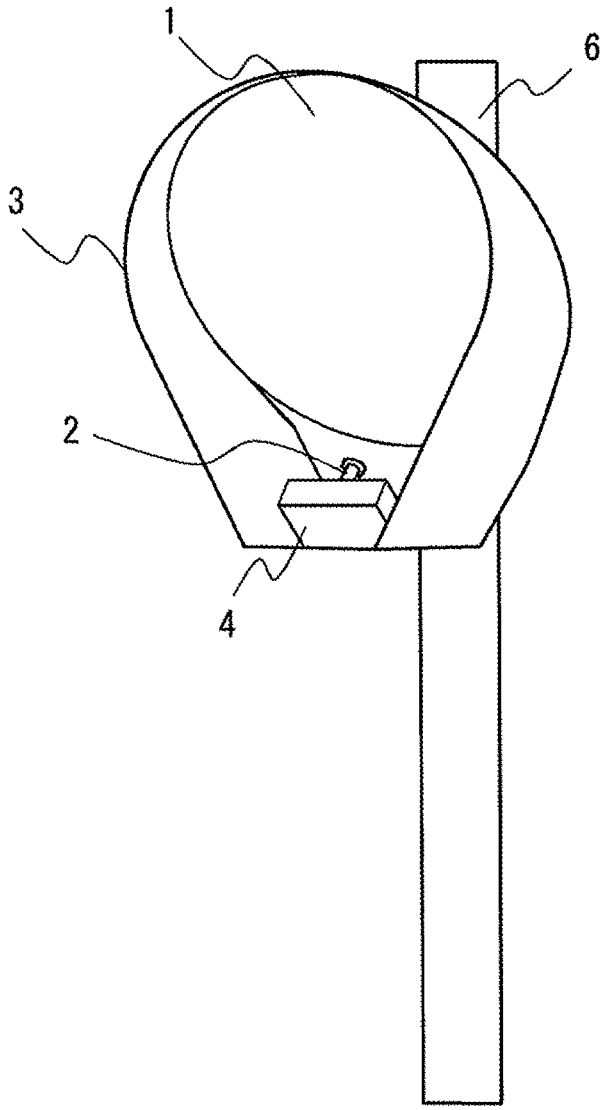
FIG. 4 is a perspective diagram of an antenna device according to an embodiment 2.
Figure 5:
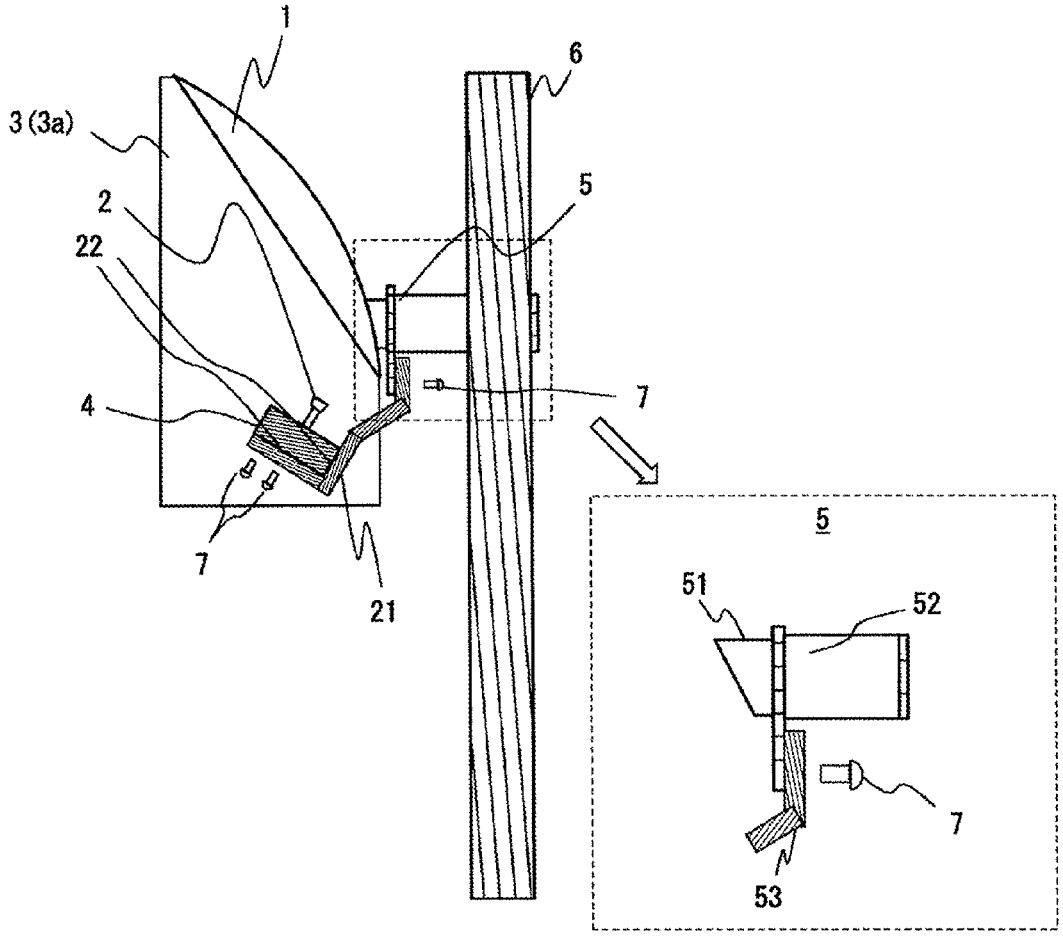
FIG. 5 is a side cross-sectional diagram of the antenna device according to the embodiment 2.

FIGS. 4 and 5 show a perspective diagram and a side cross-sectional diagram of an antenna device 20 according to the embodiment 2, respectively.

As can be seen from FIG. 5, in the antenna device 20, a support plate (support member) 21 is arranged inside the shroud 3. The support plate 21 supports the radio device 4, and is arranged at a lower inside of the shroud 3.

Here, the support plate 21 is fixed to the antenna mounting mechanism 5. In a method for fixing the support plate 21 to the antenna mounting mechanism 5, it may be fixed by attachment screws as shown in FIG. 5, or a rivet and an attachment fitting may be used. As described above, the support plate 21 is arranged at a lower side of the offset reflector 1 so that the radio device 4 to which the primary radiator 2 has been directly coupled is fixed in an inclined state.

The support plate 21 has two support surfaces 22. One of the support surfaces 22 supports a side surface (a right side surface in FIG. 5) of the radio device 4, and the other of the support surfaces 22 supports a lower base of the radio device 4. Here, the support surface 22 that supports the side surface of the radio device 4 forms an inclined surface with respect to the shroud bottom surface part 3*c* so that an angle between the support surface 22 that supports the side surface of the radio device 4 and the offset reflector 1 is larger than an angle between the shroud bottom surface part 3*c* and the offset reflector 1. The radio device 4 is installed in an inclined state by being attached to the support surface 22, which is the inclined surface. As described above, the state of the radio device 4 becomes a stably supported one by being supported by the two support surfaces 22.

The radio device 4 can be directed to a center part of the offset reflector 1 without twisting the primary radiator 2 by attaching to the support surface 22 of the support plate 21 the radio device 4 to which the primary radiator 2 has been directly coupled. It is to be noted that in a method for attaching the radio device 4 to the support plate 21, it may be fixed by an attachment screw, or may be fixed using a rivet and an adhesive.

The shroud 3 is a member having a main function to shield against unnecessary radiation, and it preferably includes a thin plate to reduce the cost or the weight of the antenna itself. Accordingly, it may be preferable that a member whose weight is comparatively heavy not be fixed to the shroud 3.

Therefore, as shown in FIG. 5, a configuration may be employed in which the antenna mounting mechanism 5 supports the support plate 21. The antenna mounting mechanism 5 shown in FIG. 5 is provided with: a reflector supporting part 51; a pole fixing part 52; and a support supporting part 53.

The reflector supporting part 51 is a support mechanism that is connected to the offset reflector 1 to support the offset reflector 1. In addition, the pole fixing part 52 is a portion connected to the antenna attachment pole 6, and it has a configuration fixable to the antenna attachment pole 6, for example, by sandwiching and fixing the antenna attachment pole 6 from a right and left thereof. That is, the pole fixing part 52 and the antenna attachment pole 6 are fixed by tightening by means of a fitting, such as a bolt, in a state where the antenna attachment pole 6 is sandwiched from a right and left thereof by the pole fixing part 52, and thereby it becomes possible to fix the antenna device 20 and the antenna attachment pole 6 to each other with a simple and high strength configuration.

The support supporting part 53 is a support mechanism that is connected to the support plate 21 to support the support plate 21 at which the radio device 4 is installed. One end of the support supporting part 53 is fixed to an end of the pole fixing part 52 by the attachment screw 7, and the other end is connected to the support plate 21. Here, a through hole through which the support supporting part 53 is passed is provided at the shroud back surface part 3*d*. Therefore, the support supporting part 53 is connected to the support plate 21 through the through hole, and thereby a configuration can be achieved in which the support plate 21 arranged inside the shroud 3 is supported by the antenna mounting mechanism 5.

By achieving the above configuration, the support plate 21 and the radio device 4 fixed thereto can be directly supported by the antenna mounting mechanism 5 with high strength, and thus the stability of the antenna device 20 can be improved.

Figure 6:
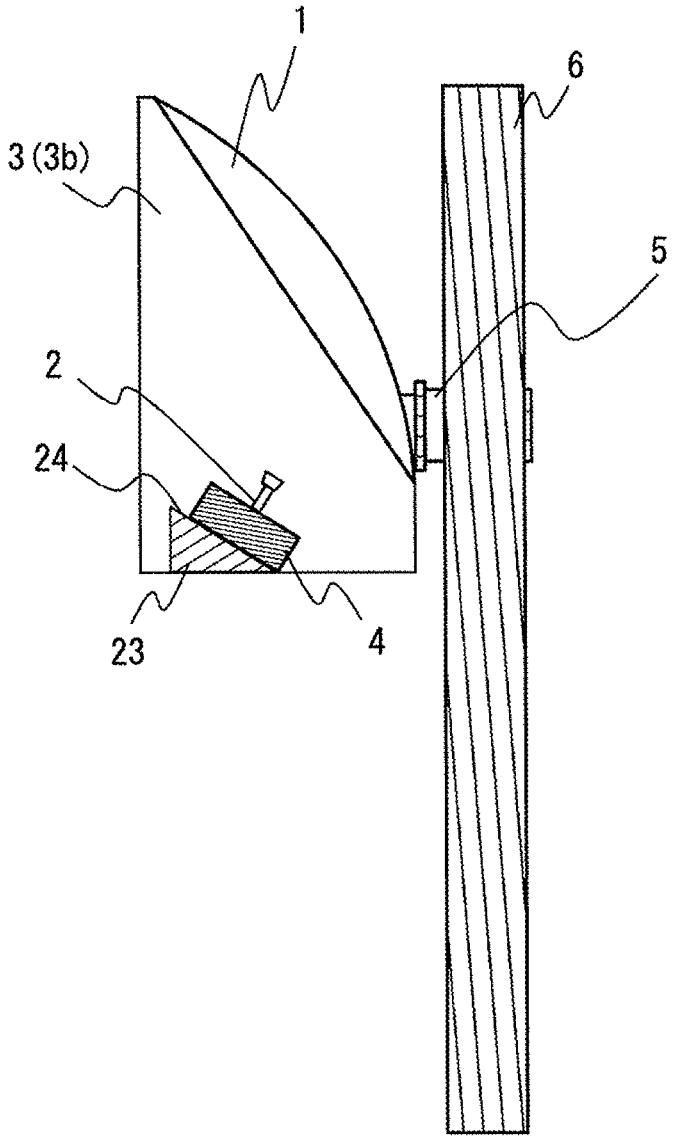
FIG. 6 is a side cross-sectional diagram of an antenna device of another mode according to the embodiment 2.

It is to be noted that a method for arranging the support plate 21 is not limited to the cases shown in FIGS. 4 to 5. For example, a support 23 is arranged at a bottom surface portion of the radio device 4 as shown in FIG. 6, and thereby it is possible to direct the primary radiator 2 to the offset reflector 1 at an appropriate angle without twisting the primary radiator 2 directly coupled to the radio device 4, as in the case of the support plate 21 of FIG. 5. The support 23 is installed at the shroud bottom surface part 3*c*, and has a support surface 24, which is an inclined surface substantially parallel to the offset reflector 1. The bottom surface of the radio device 4 is fixed to the support surface 24, and thereby the primary radiator 2 installed at a top surface of the radio device 4 is directed to the offset reflector 1.

A support member is not limited to the above-mentioned plate material, and it may instead include a plurality of bar materials. The support member can be realized by a material with sufficient rigidity to support the radio device 4. Furthermore, it may not be the inclined surface of the support member that the radio device 4 is fixed to. For example, a hollow in which the radio device 4 is stored is provided in a rectangular parallelepiped-shaped support member, and the radio device 4 is put in it, whereby the radio device can be fixed to the support member. As described above, if the radio device 4 is fixed to a certain support member, and thereby the primary radiator 2 is directed to the offset reflector 1 without a waveguide part of the primary radiator 2 directly coupled to the radio device 4 being twisted, the antenna device 10 can have a configuration other than the above-mentioned configuration.

Embodiment 3

An antenna device according to the embodiment 3 is characterized by using an ellipse-shaped offset reflector. Hereinafter, the above will be explained in detail with reference to the drawings. However, explanations of portions already explained in the embodiments 1 and 2 are partially omitted for clarity of the invention.

Figure 7:
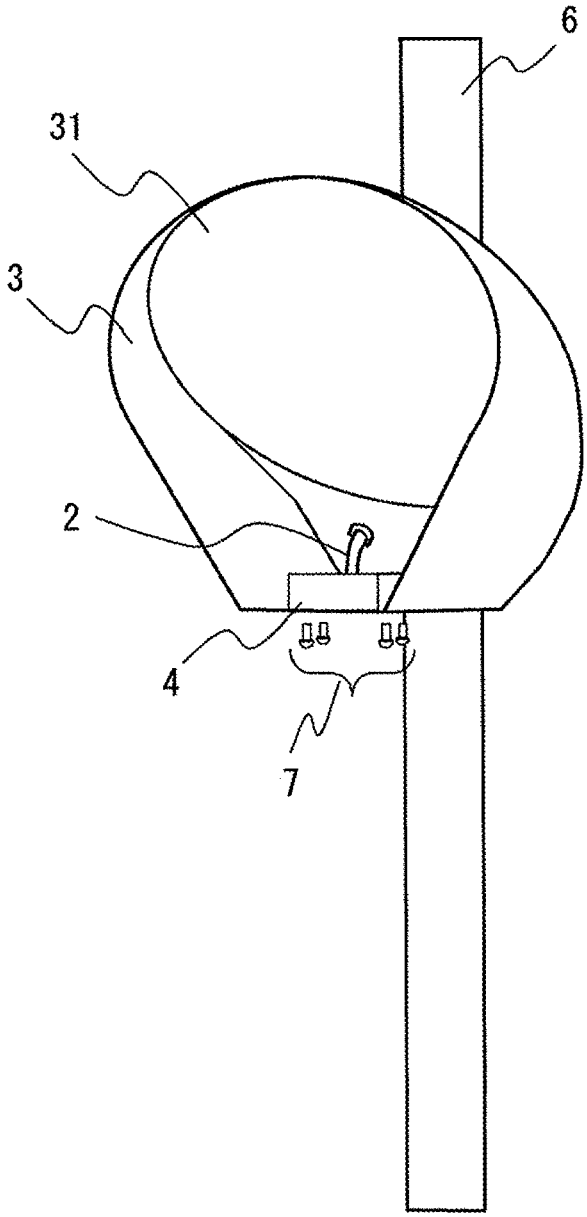
FIG. 7 is a perspective diagram of an antenna device according to an embodiment 3.
Figure 8:
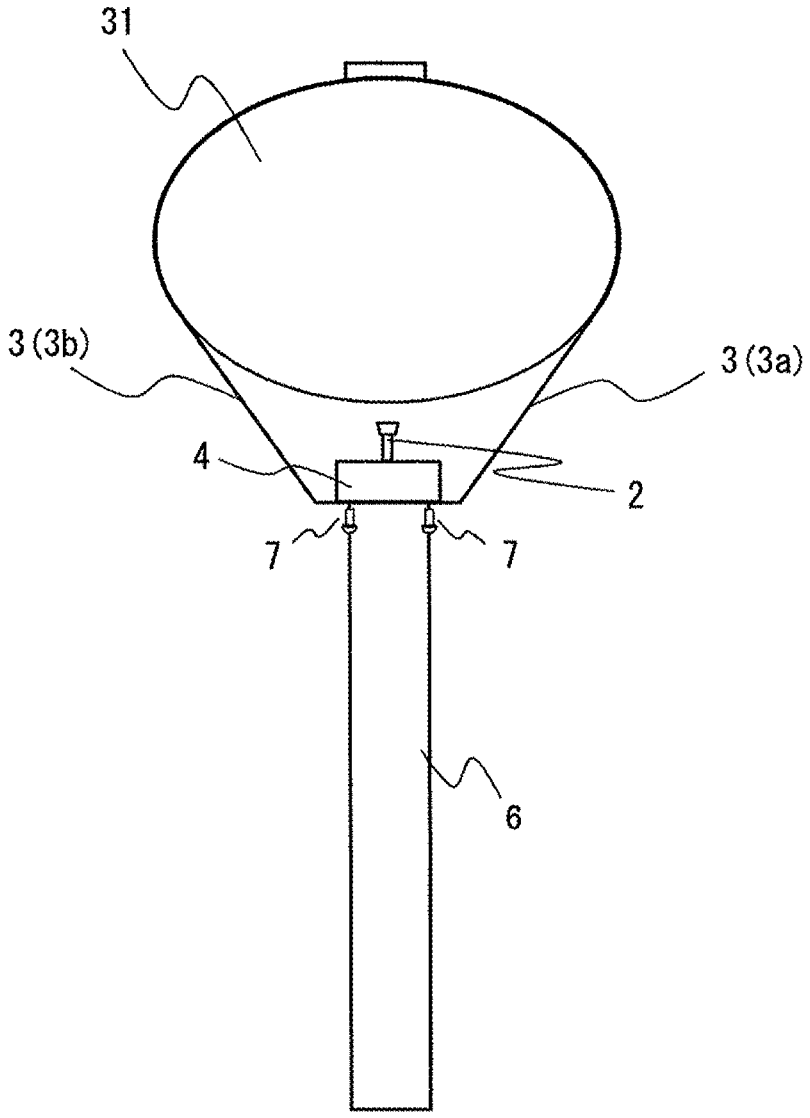
FIG. 8 is an elevational diagram of the antenna device according to the embodiment 3.

FIGS. 7 and 8 show a perspective diagram and an elevational diagram of an antenna device 30 according to the embodiment 3, respectively. As can be seen from FIGS. 7 and 8, the antenna device 30 is provided with an ellipse-shaped offset elliptical reflector 31.

As described above, a shape of a reflector is set to be elliptical, thereby an effect to enhance the low side lobe characteristic can be realized without increasing an antenna opening area, and also there is an effect of enhancing a strength characteristic of wind pressure load resistance.

Namely, in the embodiment 3, an antenna device becomes vertically long as a whole since the radio device 4 is arranged at a lower inside of the shroud 3. However, it is possible to prevent the antenna device from having a vertically longer structure by using as an offset reflector the elliptical reflector having a long axis in parallel with horizontal direction, and to reduce the antenna opening area.

It is to be noted that in this case as well, the antenna mounting mechanism 5 is attached to a lateral center position of a lower back surface of the offset elliptical reflector 31, and connects the antenna device 30 with the antenna attachment pole 6.

Embodiment 4

An antenna device according to the embodiment 4 is characterized by being further provided with a radome. Hereinafter, the above will be explained in detail with reference to the drawings. However, explanations of portions already explained in the embodiments 1 to 3 are partially omitted for clarity of the invention.

Figure 9:
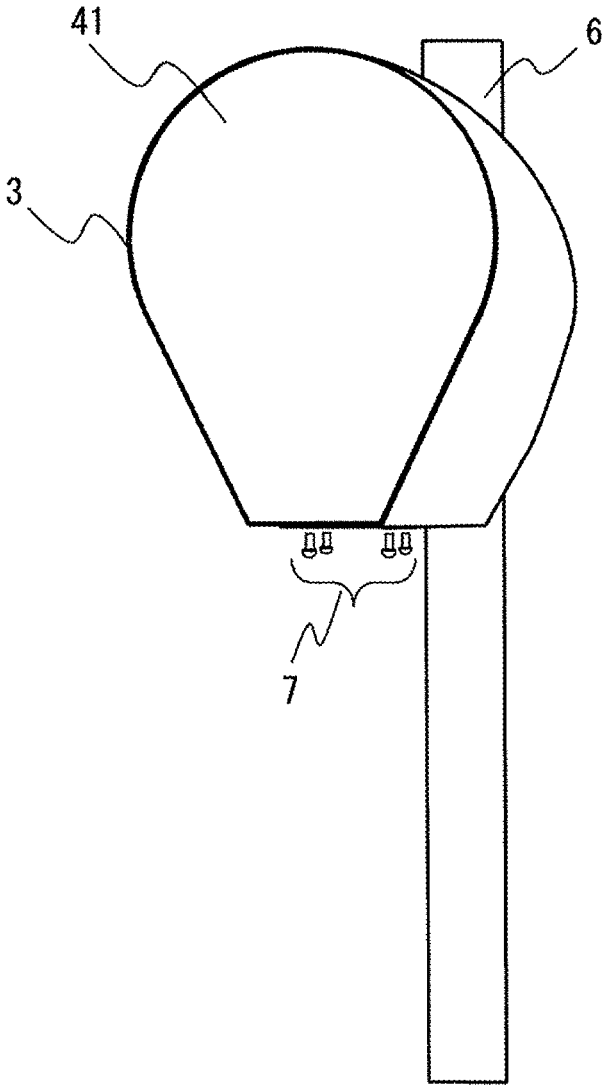
FIG. 9 is a perspective diagram of an antenna device according to an embodiment 4.

FIG. 9 is a perspective diagram of an antenna device 40 according to the embodiment 4. The antenna device 40 has a configuration newly provided with a radome 41 at an antenna opening portion in front of an offset reflector in addition to the antenna device 10 of the embodiment 1.

As described above, the effect of further enhancing a strength characteristic of wind pressure load resistance can be achieved by employing a structure having the radome in front of a shroud.

It is to be noted that as a material of the radome 41, for example, reinforced plastics can be used as a material that does not prevent passage of radio waves and has high strength, in addition to a glass fiber and Teflon (registered trademark) that have high radio wave transmittance.

As explained above, the antenna device of the embodiment 4 is characterized by being fixed to a pole in a positional relation symmetrical to the pole. With the configuration, a structure is obtained that can reduce rotation torque applied to a pole mounting bearing part, thus a demand for strength of wind pressure resistance to the antenna mounting mechanism can be reduced, and a mount structure to the antenna attachment pole can be made simple.

In addition, the antenna device of the embodiment 4 has a structure that is provided with a shroud, and in which a radio device is fitted to the shroud. Since a length of a primary radiator can be shortened by employing the structure, it becomes possible to suppress power loss of the primary radiator.

Furthermore, the length of the primary radiator can be shortened, thereby an effect of a twist in a circular waveguide for the primary radiator, which causes cross polarization, can be reduced. Therefore, a cross polarization component due to the effect of the circular waveguide twist can be reduced.

In addition, in a point-to-point communication line apparatus, as a direct coupling structure of the primary radiator and the radio device is employed, a cable that connects the antenna and the radio device and an interface converter of the antenna and the cable can be omitted, and thus a cost reduction can be achieved.

Note that the present invention is not limited to the above exemplary embodiments, and modification can be made without departing from the scope of the invention. For example, the present invention can be carried out as an antenna device in which the above-described embodiments have been combined.

In addition, although a case where the parabolic reflector is the offset parabolic reflector has been explained in the above explanation, the present invention is not limited to this. However, an effect to suppressing loss can be obtained by using the offset parabolic reflector as the parabolic reflector.

In addition, since the parabolic reflector and the radio device are integrally formed in the present invention, it is also possible to employ a transmission radio device provided with the above-described features. Namely, it is also possible to employ a radio device including: an RF circuit that generates transmission radio waves; a primary radiator that radiates the radio waves generated by the RF circuit; a parabolic reflector that reflects the radio waves radiated from the primary radiator; a shroud that shields against unnecessary radiation radio waves among the radio waves reflected by the parabolic reflector; and an antenna mounting mechanism that fits the parabolic reflector to an antenna attachment pole, in which the shroud is arranged so as to cover at least a right and left of the parabolic reflector, the RF circuit and the primary radiator are arranged inside the shroud, and in which the antenna mounting mechanism fits the parabolic reflector to the antenna attachment pole so that the antenna attachment pole is located at a lateral center position of the parabolic reflector.

A reception radio device can be similarly configured. Namely, it is also possible to employ a radio device including: a demodulation circuit that demodulates received radio waves; a primary radiator that receives radio waves from an outside of the radio device; a parabolic reflector that reflects radio waves radiated from the outside to the primary radiator and makes the primary radiator receive the radio waves; a shroud that shields the parabolic reflector from radio waves requiring no reception among the radio waves from the outside of the radio device; and an antenna mounting mechanism that fits the parabolic reflector to an antenna attachment pole, in which the shroud is arranged so as to cover at least a right and left of the parabolic reflector, the demodulation circuit and the primary radiator are arranged inside the shroud, and in which the antenna mounting mechanism fits the parabolic reflector to the antenna attachment pole so that the antenna attachment pole is located at a lateral center position of the parabolic reflector.

Furthermore, the present invention also includes a method for manufacturing an antenna device. This manufacturing method is specifically as follows. Firstly, a shroud is provided so as to cover at least a right and left of a parabolic reflector that reflects radio waves, a radio device for radio wave transmission or for radio wave reception is provided inside the shroud, and a primary radiator that has a function to radiate radio waves generated by the radio device or a function to feed received radio waves to the radio device is provided inside the shroud so that the parabolic reflector reflects the radio waves radiated from the primary radiator to an outside of the antenna device or reflects radio waves from an outside of the antenna device so that the primary radiator receives the radio waves. Secondly, an antenna mounting mechanism that fits the parabolic reflector to an antenna attachment pole is provided in order for the parabolic reflector to be fitted to the antenna attachment pole so that the antenna attachment pole is located at a lateral center position of the parabolic reflector.

The antenna device can be manufactured by the above method. It is to be noted that an execution order of the first and second steps listed above is not fixed, and that a change of the order can be appropriately made. In addition, in the first and second steps, another component of the antenna device may be provided (arranged). For example, in the first step, a support member may be arranged inside the shroud, as is done in the embodiment 2.

In addition to the above, the present invention can take the following configurations.

APPENDIX 1

An antenna device including: a radio device for radio wave transmission or for radio wave reception; a primary radiator that has a function to radiate radio waves generated by the radio device or a function to feed received radio waves to the radio device; a parabolic reflector that reflects the radio waves radiated from the primary radiator or makes the primary radiator receive radio waves by reflecting the radio waves; a shroud that shields against unnecessary radiation radio waves among the radio waves radiated from the primary radiator and reflected by the parabolic reflector, or shields against radio waves requiring no reception so that the radio waves requiring no reception are not reflected by the parabolic reflector and are not received by the primary radiator; and an antenna mounting mechanism that fits the parabolic reflector to an antenna attachment pole, wherein the shroud is arranged so as to cover at least a right and left of the parabolic reflector, the radio device and the primary radiator are arranged inside the shroud, and the antenna mounting mechanism fits the parabolic reflector to the antenna attachment pole so that the antenna attachment pole is located at a lateral center position of the parabolic reflector.

APPENDIX 2

The antenna device according to Appendix 1, wherein the radio device and the primary radiator are directly coupled to each other, and the radio device is arranged at a lower inside of the shroud.

APPENDIX 3

The antenna device according to Appendix 2, further comprising a support member that supports the radio device, wherein the support member is arranged inside the shroud, and thereby the radio device fixed to the support member is arranged inside the shroud.

APPENDIX 4

The antenna device according to Appendix 3, wherein the radio device is fixed to the support member, and thereby a waveguide part of the primary radiator directly coupled to the radio device is directed to the parabolic reflector without being twisted.

APPENDIX 5

The antenna device according to Appendices 3 or 4, wherein the antenna mounting mechanism further includes a connection mechanism that is connected to the support member, and the support member is supported by an inside of the shroud by being connected to the connection mechanism.

APPENDIX 6

The antenna device according to any one of Appendices 1 to 5, wherein the parabolic reflector is an offset parabolic reflector.

APPENDIX 7

The antenna device according to Appendix 6, wherein a shape of the offset parabolic reflector is a circle.

APPENDIX 8

The antenna device according to Appendix 6, wherein a shape of the offset parabolic reflector is an ellipse.

APPENDIX 9

The antenna device according to any one of Appendices 1 to 8, further comprising a radome arranged in front of the parabolic reflector.

APPENDIX 10

A method for attaching an antenna device, wherein a shroud is provided so as to cover at least a right and left of a parabolic reflector that reflects radio waves, a radio device for radio wave transmission or for radio wave reception is provided inside the shroud, and a primary radiator that has a function to radiate radio waves generated by the radio device or a function to feed received radio waves to the radio device is provided inside the shroud so that the parabolic reflector reflects the radio waves radiated from the primary radiator to an outside of the antenna device or reflects radio waves from the outside of the antenna device so that the primary radiator receives the radio waves, and an antenna mounting mechanism that fits the parabolic reflector to an antenna attachment pole is provided in order for the parabolic reflector to be fitted to the antenna attachment pole so that the antenna attachment pole is located at a lateral center position of the parabolic reflector.

APPENDIX 11

The antenna device described in any of Appendices 1 to 9, in which a radio wave absorber is installed inside the shroud.

APPENDIX 12

An antenna device including: an offset parabolic reflector; a primary radiator; a shroud; a radio device; and an antenna mounting mechanism, in which the radio device and the primary radiator are fitted inside the shroud, and in which the antenna mounting mechanism and the antenna attachment pole are fitted to a lateral center position of the offset parabolic reflector.

While the invention has been particularly shown and described with reference to exemplary embodiments thereof, the invention is not limited to these embodiments. It will be understood by those of ordinary skill in the art that various changes in form and details may be made therein without departing from the spirit and scope of the invention as defined by the claims.

This application is based upon and claims the benefit of priority from Japanese patent application No. 2012-106616, filed on May 8, 2012, the disclosure of which is incorporated herein in its entirety by reference.

INDUSTRIAL APPLICABILITY

The present invention can be utilized in order to achieve a cost reduction and to improve a strength characteristic of wind pressure load resistance and a power loss characteristic in an antenna device and an attachment method of the same.

REFERENCE SIGNS LIST

| | | | |
|---|---|---|---|
| 1 | OFFSET REFLECTOR | 2 | PRIMARY RADIATOR |
| 3 | SHROUD | | |
| 3a | SHROUD RIGHT SIDE SURFACE PART | | |
| 3b | SHROUD LEFT SIDE SURFACE PART | | |
| 3c | SHROUD BOTTOM SURFACE PART | | |
| 3d | SHROUD BACK SURFACE PART | | |
| 4 | RADIO DEVICE | | |
| 5 | ANTENNA MOUNTING MECHANISM | 7 | ATTACHMENT SCREW |
| 6 | ANTENNA ATTACHMENT POLE | | |
| 10 | ANTENNA DEVICE | 20 | ANTENNA DEVICE |
| 21 | SUPPORT PLATE (SUPPORT MEMBER) | 22 | SUPPORT SURFACE |
| 23 | SUPPORT (SUPPORT MEMBER) | 24 | SUPPORT SURFACE |
| 30 | ANTENNA DEVICE | | |
| 31 | OFFSET ELLIPTICAL REFLECTOR | | |
| 40 | ANTENNA DEVICE | 41 | RADOME |
| 51 | REFLECTOR SUPPORTING PART (REFLECTOR SUPPORTING MECHANISM) | | |
| 52 | POLE FIXING PART | | |
| 53 | SUPPORT SUPPORTING PART (SUPPORT SUPPORTING MECHANISM) | | |

The invention claimed is:

1. An antenna device comprising:

a radio device for radio wave transmission;

a primary radiator that has a function to radiate radio waves generated by the radio device;

a parabolic reflector that reflects the radio waves radiated from the primary radiator;

a shroud that shields against unnecessary radiation radio waves among the radio waves radiated from the primary radiator and reflected by the parabolic reflector; and an antenna mounting mechanism that fits the parabolic reflector to an antenna attachment pole, wherein the shroud comprises a right side surface part and a left side surface part that cover a right and a left, respectively, of the parabolic reflector, the right side surface part and the left side surface part projecting to a front of the parabolic reflector and being connected to each other near a vertex of an upper part of the parabolic reflector, the radio device and the primary radiator are arranged inside the shroud, and the antenna mounting mechanism fits the parabolic reflector to the antenna attachment pole so that the antenna attachment pole is located at a lateral center position of the parabolic reflector.

2. The antenna device according to claim 1, wherein the radio device and the primary radiator are directly coupled to each other, and the radio device is arranged at a lower inside of the shroud.

3. The antenna device according to claim 2, further comprising a support member that supports the radio device, wherein the support member is arranged inside the shroud, and thereby the radio device supported by the support member is arranged inside the shroud.

4. The antenna device according to claim 3, wherein the radio device is fixed to the support member, and thereby a waveguide part of the primary radiator directly coupled to the radio device is directed to the parabolic reflector without being twisted.

5. The antenna device according to claim 3, wherein the antenna mounting mechanism further includes a connection mechanism that is connected to the support member, and the support member is supported by an inside of the shroud by being connected to the connection mechanism.

6. The antenna device according to claim 1, wherein the parabolic reflector is an offset parabolic reflector.

7. The antenna device according to claim 6, wherein a shape of the offset parabolic reflector is a circle.

8. The antenna device according to claim 6, wherein a shape of the offset parabolic reflector is an ellipse.

9. A method for attaching an antenna device, wherein providing a shroud, the shroud comprising a right side surface part and a left side surface part that cover a right and a left, respectively, of a parabolic reflector that reflects radio waves, the right side surface part and the left side surface part projecting to a front of the parabolic reflector and being connected to each other near a vertex of an upper part of the parabolic reflector, providing a radio device for radio wave transmission or for radio wave reception inside the shroud, and providing a primary radiator that has a function to radiate radio waves generated by the radio device or a function to feed received radio waves to the radio device inside the shroud so that the parabolic reflector reflects the radio waves radiated from the primary radiator to an outside of the antenna device or reflects radio waves from an outside of the antenna device so that the primary radiator receives the radio waves, and providing an antenna mounting mechanism that fits the parabolic reflector to an antenna attachment pole in order for the parabolic reflector to be fitted to the antenna attachment pole so that the antenna attachment pole is located at a lateral center position of the parabolic reflector.

10. An antenna device comprising:

a radio device for radio wave reception;

a primary radiator that has a function to feed received radio waves to the radio device;

a parabolic reflector that makes the primary radiator receive radio waves by reflecting the radio waves;

a shroud that shields against radio waves requiring no reception so that the radio waves requiring no reception are not reflected by the parabolic reflector and are not received by the primary radiator; and an antenna mounting mechanism that fits the parabolic reflector to an antenna attachment pole, wherein the shroud comprises a right side surface part and a left side surface part that cover a right and a left, respectively, of the parabolic reflector, the right side surface part and the left side surface part projecting to a front of the parabolic reflector and being connected to each other near a vertex of an upper part of the parabolic reflector, the radio device and the primary radiator are arranged inside the shroud, and the antenna mounting mechanism fits the parabolic reflector to the antenna attachment pole so that the antenna attachment pole is located at a lateral center position of the parabolic reflector.

* * * * *